US005356330A

United States Patent [19]

Cohen

[11] Patent Number: 5,356,330

[45] Date of Patent: Oct. 18, 1994

[54] APPARATUS FOR SIMULATING A "HIGH FIVE"

[76] Inventor: Albert Cohen, 176 N. Lake Ave., Troy, N.Y. 12180

[21] Appl. No.: 163,856

[22] Filed: Dec. 7, 1993

[51] Int. Cl.[5] ..... A63H 33/00; A63H 3/36

[52] U.S. Cl. ..... 446/491; 446/390; 472/70

[58] Field of Search ..... 446/390, 485, 491; 40/418, 490; 472/70; 482/83, 84, 85, 86

[56] References Cited

U.S. PATENT DOCUMENTS

| | | | |
|---|---|---|---|
| 1,425,945 | 8/1922 | Congdon . | |
| 2,484,343 | 10/1949 | Hawes . | |
| 2,585,780 | 2/1952 | Johnson . | |
| 2,937,872 | 5/1960 | Gilman . | |
| 3,252,242 | 5/1966 | Zalkind . | |
| 3,427,021 | 2/1969 | Donato | 482/83 |
| 3,755,960 | 9/1973 | Tepper et al. | 446/299 |
| 3,804,406 | 4/1974 | Viscione | 482/83 X |
| 3,877,697 | 4/1975 | Lersch . | |
| 3,927,879 | 12/1975 | Long et al. | 482/83 |
| 4,381,620 | 5/1983 | Panzarella . | |
| 5,171,197 | 12/1992 | Healy et al. | 482/83 |

FOREIGN PATENT DOCUMENTS

| | | | |
|---|---|---|---|
| 563984 | 7/1977 | U.S.S.R. | 482/83 |

*Primary Examiner*—Robert A. Hafer
*Assistant Examiner*—D. Neal Muir
*Attorney, Agent, or Firm*—Schmeiser, Morelle & Watts

[57] ABSTRACT

An apparatus for simulating a "high-five" including a lower arm portion having a simulated hand removably attached thereto, an upper arm portion, an elbow joint for pivotally securing the lower arm portion to the upper arm portion, and a spring biasing element for biasing the upper and lower arm portions towards a predetermined alignment.

12 Claims, 3 Drawing Sheets

APPARATUS FOR SIMULATING A "HIGH FIVE"

FIELD OF THE INVENTION

The present invention relates to amusement and/or exercise devices and, more particularly, to a self-righting hand-arm configuration which is adapted to pivot when struck by a user, thereby simulating a "high five".

BACKGROUND OF THE INVENTION

During a televised sporting event, a "high five" is commonly shared between fans to express the joy and excitement of a touchdown, home run, game-winning basket, birdie or other positive occurrence. Unfortunately, as known in the art, a "high five" requires the mutual hand slapping of two participants, wherein a first participant slaps an upraised hand against the elevated hand of a second participant. As such, a solitary fan is unable to perform a "high five" to express excitement during a televised sporting event.

SUMMARY OF THE INVENTION

In order to avoid the disadvantages of the prior art, the present invention provides a pivotable, self-righting hand-arm configuration for simulating a "high five" when struck by the hand of a user.

The hand-arm configuration of the present invention generally comprises a lower arm portion for simulating the forearm of a human, an upper arm portion for simulating the upper arm of a human, and an elbow joint for pivotally securing a first end portion of the lower arm portion to a first end portion of the upper arm portion. Further, the hand-arm configuration includes a biasing element, such as a spring or the like, for biasing the upper and lower arm portions towards a predetermined alignment, a simulated hand, removably attached to an opposing, distal end portion of the lower arm portion, and a mounting arrangement for securing the hand-arm configuration to a supporting structure such as a table, wall, floor or the like.

In accordance with a first embodiment of the present invention, the lower and upper arm portions of the hand-arm configuration are maintained in a perpendicularly disposed relationship, with the lower arm portion and the attached, simulated hand, extending vertically upwards from a horizontally projecting upper arm portion. More specifically, the biasing element is adapted to continuously pivot the lower arm portion about the elbow joint until the appropriate, vertically extending orientation is achieved. To prevent the lower arm portion from pivoting past vertical in response to the biasing force of the biasing element, the elbow joint is provided with a suitably disposed pivot stop element. In operation, the lower arm portion is adapted to be pivotally displaced towards the horizontally projecting upper arm portion in response to the impact of a user's hand against the attached, simulated hand. As the force of the impact is overpowered by the opposing force of the biasing element, the lower arm portion is subsequently returned to its original, vertically extending position against the pivot stop element.

In a second embodiment of the present invention, the lower and upper arm portions of the hand-arm configuration are maintained in a vertically aligned, linear relationship. The lower and upper arm portions are pivotally connected by an elbow joint, and a biasing element is utilized to continuously pivot the lower arm portion in an upward direction about the elbow joint until the lower and upper arm portions are vertically aligned. Again, as in the first embodiment of the present invention, the elbow joint is provided with a suitably disposed pivot stop element to prevent the lower arm portion from pivoting past vertical in response to the biasing force of the biasing element. In response to the impact of a user's hand against the attached, simulated hand, the lower arm portion is pivoted about the elbow joint, and subsequently returned to its original, vertical orientation against the pivot stop element by the opposing force of the biasing element.

As described above, the hand-arm configuration of the invention allows a user to simulate a "high-five" in celebration of a positive event, thereby providing the user with a convenient outlet for the release of excitement. Further, the hand-arm configuration synergistically improves the hand-eye coordination of a user and/or, depending upon specific placement, provides an exercise device for enhancing the jumping skills of a user. More specifically, when the hand-arm configuration is mounted at a sufficient height above the normal reach of a user, the user must jump upwards to strike the simulated hand, thereby simulating many of the jumping drills commonly practiced by basketball players. As such, the leg strength and coordination of a user may be improved through the practice of the present invention.

The upper and lower arm portion of the hand-arm configuration are preferably covered with a layer of padding to more closely emulate the shape of a human arm. The padding may be enclosed by an appropriately colored, simulated skin layer formed of any suitable material such as rubber or plastic, and/or may be attired with an outer, fabric shirt sleeve. Preferably, the shirt sleeve is suitably colored to represent a professional or amateur sports team, and includes a number or other indicia thereon representative of a specific player on a sports team.

The removable (interchangeable) simulated hand is preferably formed of a moldable plastic or rubber material in the shape of an average size human hand, although oversized and other novelty hands may be utilized. To further represent a specific player on a sports team, the simulated hand may be an actual replica of the player's hand.

The present invention may further incorporate a sound system, comprising a miniaturized, battery operated sound generator and speaker, for outputting a predetermined or user selectable sound in response to the striking of the simulated hand. A wide variety of output sounds may be provided, including the cheer of a crowd or the voice of a specific player. A switch is utilized to actuate the sound system, preferably upon the pivotable displacement of the lower arm portion. Alternately, or in conjunction with the sound system, the present invention may further include a light or other visual system, for outputting a visual signal in response to the striking of the simulated hand.

BRIEF DESCRIPTION OF THE DRAWINGS

These and other features of the present invention will become readily apparent upon reading the following detailed description and upon reference to the drawings in which.

DETAILED DESCRIPTION OF THE INVENTION

Figure 4:
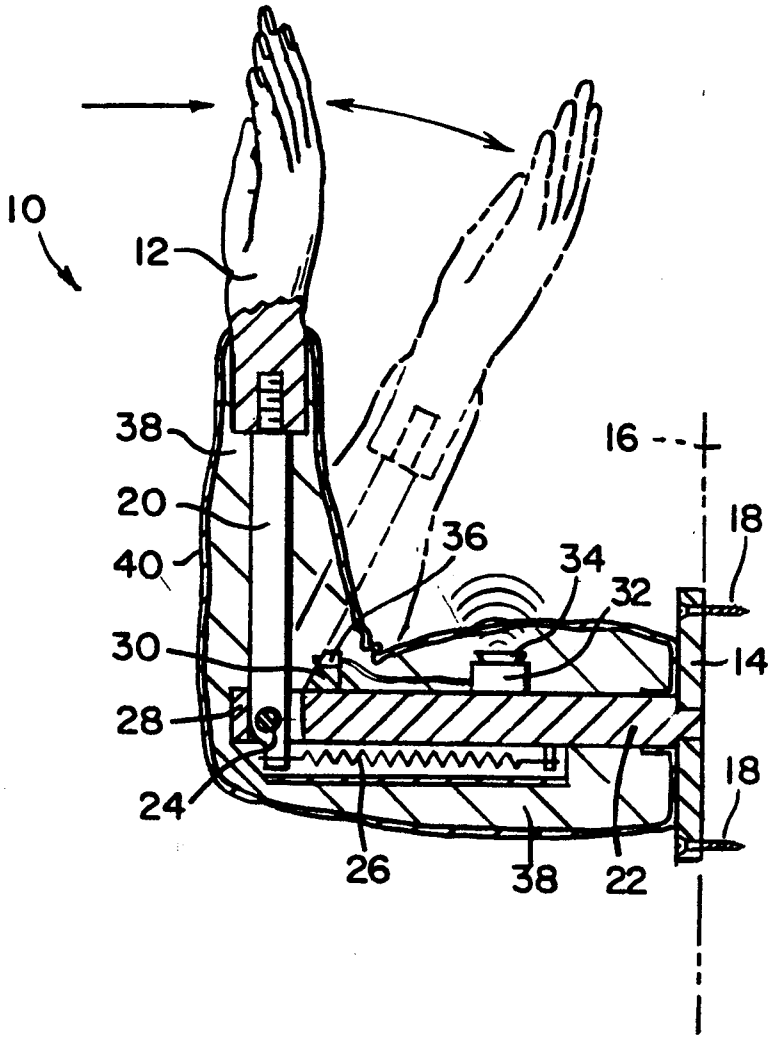
FIG. 4 is a side cross-sectional view of the hand-arm configuration.
Figure 1:
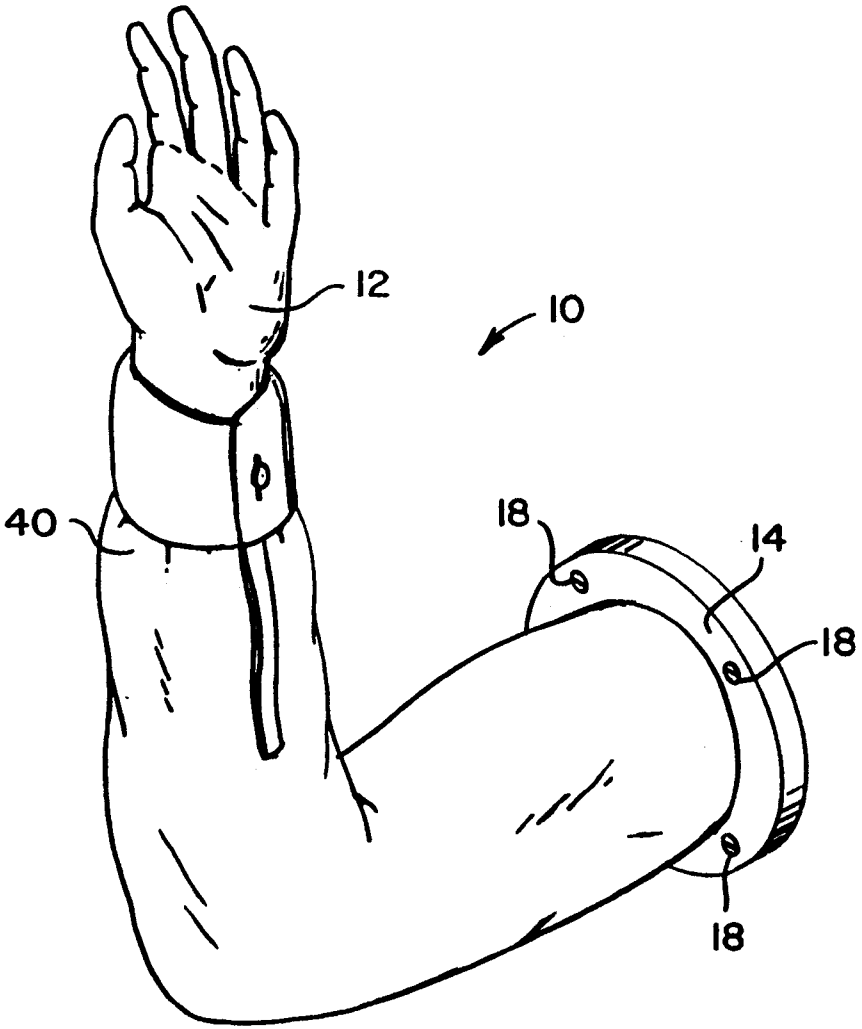
FIG. 1 is a perspective view of a pivotable, self-righting hand-arm configuration for simulating a "high five" when struck by the hand of a user, in accordance with a first embodiment of the present invention.
Figure 3:
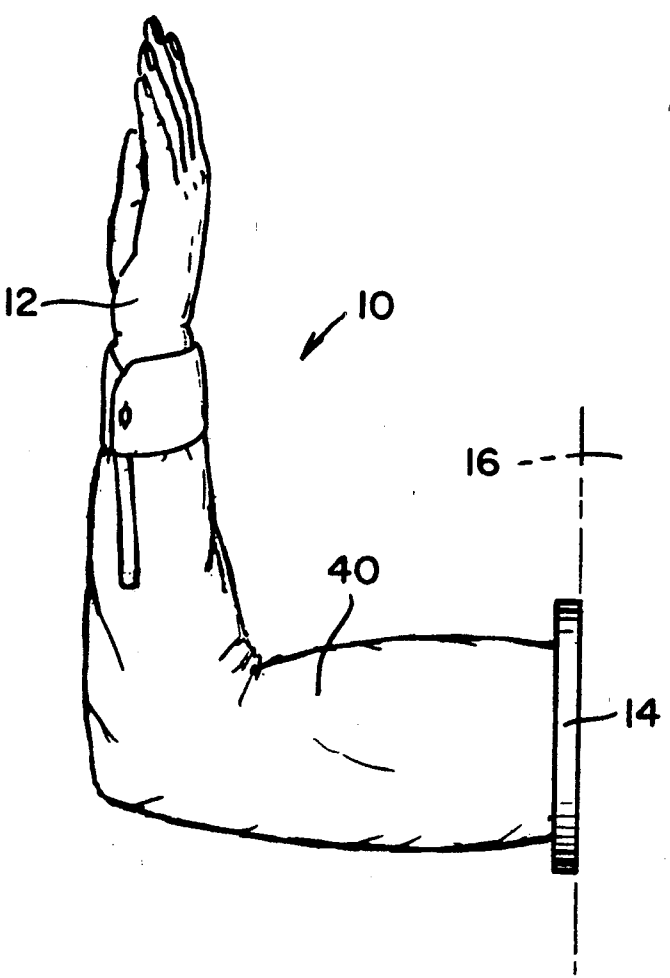
FIG. 3 is a side view of the hand-arm configuration of FIG. 1.
Figure 2:
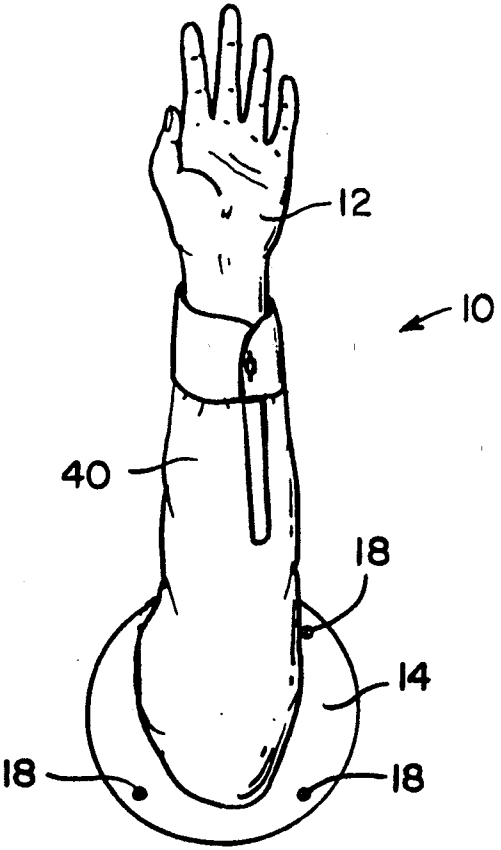
FIG. 2 is a front view of the hand-arm configuration of FIG. 1.

Referring now specifically to the drawings, there is illustrated a hand-arm configuration for simulating a "high five" when struck by a user, wherein like reference numerals refer to like components throughout the drawings.

A first embodiment of the hand-arm configuration, generally designated as 10, is illustrated in FIGS. 1–4. More specifically, the hand-arm configuration 10 includes a simulated hand 12 which is removably securable to a perpendicularly oriented, arm system. A mounting arrangement 14 is provided to secure the hand-arm configuration 10 to a vertical surface 16 such as a wall or the like. Screws 18, or other suitable fastening hardware, are utilized to fixedly secure the mounting arrangement and attached hand-arm configuration 10 to the vertical surface 16. The hand-arm configuration 10 may be formed integrally with the mounting arrangement 14, or may be removably secured thereto.

Referring now specifically to FIG. 4, there is illustrated a side cross-sectional view of the hand-arm configuration 10. The hand-arm configuration 10 generally comprises a lower arm portion 20 for simulating a human forearm, an upper arm portion 22 for simulating the upper arm of a human, and an elbow joint 24 for pivotally joining the lower arm portion 20 and the upper arm portion 22. A biasing spring 26 is utilized to bias the lower arm portion 20 towards and against a first stop element 28. As illustrated, the biasing spring 26 and the first stop element 28 are adapted to collectively maintain the lower arm portion 20 and attached, simulated hand 12 in a vertical orientation, perpendicular to the horizontally projecting upper arm portion 22.

When the simulated hand 12 is struck by a user, the lower arm portion 20 is adapted to pivot about the elbow joint 24 towards the upper arm portion 22, thereby simultaneously elongating the biasing spring 26. Thereafter, the lower arm portion 20 is directed towards its original, vertical position against the first stop member 28 by the expansive force of the biasing spring 26. A second stop element 30, preferably having a beveled front surface, may be provided to limit the pivotable displacement of the lower arm portion 20 towards the upper arm portion 22.

A sound system, comprising a miniaturized, battery operated sound generator 32, speaker 34 and switch 36, is utilized to output a predetermined sound in response to a user actuated displacement of the lower arm portion 22. Preferably, the switch 36 is activated when the lower arm portion 20 contacts the second stop element 30.

The lower and upper arm portions 20, 22, are enclosed by a layer of padding 38 which is suitably configured to simulate a human arm. A shirt sleeve 40 is utilized to conceal the padding 38.

Figure 5:
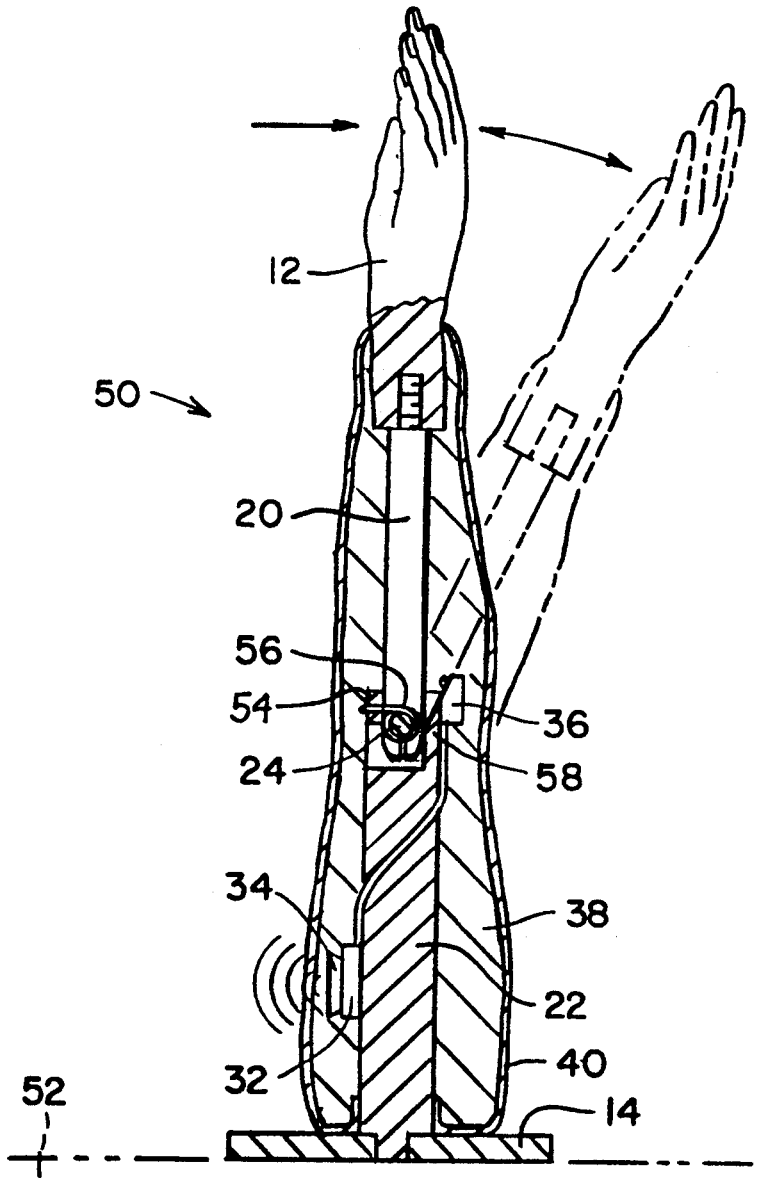
FIG. 5 is a side cross-sectional view of a hand-arm configuration in accordance with a second embodiment of the present invention.

Referring now specifically to FIG. 5, there is illustrated a side cross-sectional view of a hand-arm configuration 50 for simulating a "high five", in accordance with a second embodiment of the present invention. As in the first embodiment of the present invention, the hand-arm configuration 50 includes a lower arm portion 20 having a simulated hand 12 removably attached thereto, an upper arm portion 22, an elbow joint 24 for pivotally joining the lower arm portion 20 and the upper arm portion 22, a mounting arrangement 14 for securing the hand-arm configuration 50 to a horizontal surface 52, a sound system comprising a miniaturized, battery operated sound generator 32, speaker 34 and switch 36, a layer of padding 38 and a shirt sleeve 40. Unlike the first embodiment, however, the lower and upper arm portions 20, 22 of the hand-arm configuration 50 are maintained in a substantially vertically aligned, linear relationship by a first stop element 54 and a torsional biasing spring 56. More specifically, the torsional biasing spring 56 is adapted to continuously bias the lower arm portion 20 towards and against the first stop member 54.

In operation, the lower arm portion 20 is pivotally displaced about the elbow joint 24, towards the horizontal surface 52, in response to the impact of a user's hand against the attached, simulated hand 12, and subsequently returned towards the first stop element 54 by the action of the torsional biasing spring 56. A second stop element 58, again preferably including a beveled front surface for receiving the lower arm portion thereagainst, is provided to limit the pivotable displacement of the lower arm portion towards the horizontal surface 52.

The foregoing description of the preferred embodiments of the invention has been presented for purposes of illustration and description. It is not intended to be exhaustive or to limit the invention to the precise form disclosed, and obviously many modifications and variations are possible in light of the above teaching. For example, the hand-arm configuration may be suitably configured and costumed to simulate the arm of an animal such as a gorilla or the like. Such modifications and variations that may be apparent to a person skilled in the art are intended to be included within the scope of this invention as defined by the accompanying claims.

I claim:

1. An apparatus for simulating a "high five" comprising:

a first, movable arm portion for simulating a forearm, said first arm portion having a simulated hand secured thereto;

a second, immovable arm portion for simulating an upper arm;

a mounting arrangement for mounting said second arm portion to a supporting surface;

a pivot member for pivotally securing said first arm portion to said second arm portion, wherein said first arm portion is adapted to be pivotally displaced about said pivot member along a single plane when struck by a user, with said second, immovable arm portion remaining stationary;

a stop arrangement for limiting the pivotable displacement of said first arm portion along said single plane; and a biasing element, formed independently of said stop arrangement, for biasing said first arm portion towards and against said stop arrangement and for maintaining said first and second arm portions in a predetermined alignment;

wherein said first arm portion is adapted to be dislodged from against said stop arrangement, and pivotally displaced about said pivot member along said single plane, when said simulated hand is struck by a user, said biasing element subsequently biasing said first arm portion towards and against said stop arrangement, thereby reestablishing said predetermined alignment.

2. The apparatus according to claim 1 further including:

a sound generating system for outputting a sound in response to the pivotable displacement of said first arm portion.

3. The apparatus according to claim 1 wherein said simulated hand is removably securable to said first arm portion.

4. The apparatus according to claim 1 wherein, in said predetermined alignment, said first and second arm portions are maintained in a substantially perpendicular relationship.

5. The apparatus according to claim 4 wherein, in said substantially perpendicular relationship, said second arm portion is adapted to project substantially horizontally from said supporting surface and said first arm portion is adapted to extend substantially perpendicularly from said second arm portion.

6. The apparatus according to claim 1 wherein, in said predetermined alignment, said first and second arm portions are maintained in a substantially linear relationship.

7. An amusement device comprising:

a first, movable arm portion having a simulated hand secured thereto;

a second, immovable arm portion;

a mounting arrangement for mounting said second arm portion to a supporting surface;

a pivot member for pivotally securing said first arm portion to said second arm portion, wherein said first arm portion is adapted to be pivotally displaced about said pivot member along a single plane when struck by a user, with said second, immovable arm portion remaining stationary;

a stop arrangement for limiting the pivotable displacement of said first arm portion along said single plane; and a biasing element, formed independently of said stop arrangement, for biasing said first arm portion towards and against said stop arrangement and for maintaining said first and second arm portions in a predetermined alignment;

wherein said first arm portion is adapted to be dislodged from against said stop arrangement, and pivotally displaced about said pivot member along said single plane, when said simulated hand is struck by a user, said biasing element subsequently biasing said first arm portion towards and against said stop arrangement, thereby reestablishing said predetermined alignment.

8. The amusement device according to claim 7 further including:

a sound generating system for outputting a sound in response to the pivotable displacement of said first arm portion.

9. The amusement device according to claim 8 wherein said sound generating system further includes:

a switch, actuated by said first arm portion, for activating said sound generating system in response to the pivotable displacement of said first arm portion.

10. The apparatus according to claim 7 wherein, in said predetermined alignment, said first and second arm portions are maintained in a substantially perpendicular relationship.

11. The apparatus according to claim 10 wherein, in said substantially perpendicular relationship, said second arm portion is adapted to project substantially horizontally from said supporting surface and said first arm portion is adapted to extend substantially perpendicularly from said second arm portion.

12. The apparatus according to claim 7 wherein, in said predetermined alignment, said first and second arm portions are maintained in a substantially linear relationship.

* * * * *